United States Patent [19]

Gillette et al.

[11] 4,449,328

[45] May 22, 1984

[54] INSIDE, OUTSIDE HONING TOOL

[75] Inventors: Robert H. Gillette; Terrence N. Brammall; Kent Shelton; Chris Cramer, all of Angola, Ind.

[73] Assignee: Brammall, Inc., Angola, Ind.

[21] Appl. No.: 346,109

[22] Filed: Feb. 5, 1982

Related U.S. Application Data

[62] Division of Ser. No. 138,700, Apr. 9, 1980, Pat. No. 4,323,646.

[51] Int. Cl.[3] ..... B24B 5/00

[52] U.S. Cl. ..... 51/73 R; 51/338

[58] Field of Search ..... 51/338–346, 51/73 R, 73 GC; 294/86.29, 86.3; 15/104.04, 104.01 R, 104.15

[56] References Cited

U.S. PATENT DOCUMENTS

| | | | |
|---|---|---|---|
| 761,634 | 5/1904 | Hungerford et al. | 51/73 R |
| 1,418,847 | 6/1922 | Stimson | 51/343 X |
| 1,647,133 | 11/1927 | Jennings | 51/351 |
| 2,105,024 | 1/1938 | Connor | 51/346 |
| 2,159,962 | 5/1939 | Blood | 51/339 |
| 2,238,326 | 4/1941 | Indge | 51/348 X |
| 2,264,360 | 12/1941 | Carlin et al. | 51/339 |
| 2,911,768 | 11/1959 | Peden . | |

FOREIGN PATENT DOCUMENTS

| | | | |
|---|---|---|---|
| 608117 | 11/1960 | Canada | 51/338 |
| 2603233 | 9/1976 | Fed. Rep. of Germany | 51/73 R |

*Primary Examiner*—E. R. Kazenske
*Assistant Examiner*—Douglas D. Watts
*Attorney, Agent, or Firm*—Hill, Van Santen, Steadman & Simpson

[57] ABSTRACT

Tools for honing an exterior cylindrical reference surface and for honing an interior cylindrical surface concentric with but offset from the reference surface each have a cylindrical feed sleeve slidable axially along the outside of the tool body. As the sleeve is movable axially with respect to the tool body, a plurality of honing stones carried by the tool body moves radially with respect to the cylindrical surface being honed.

1 Claim, 8 Drawing Figures

INSIDE, OUTSIDE HONING TOOL

This is a division, of application Ser. No. 138,700, filed Apr. 9, 1980 now U.S. Pat. No. 4,323,646.

BACKGROUND OF THE INVENTION

1. Field of the Invention

The invention pertains to the field of honing tools.

2. The Prior Art

Honing tools are known, such as the tools disclosed in U.S. Pat. No. 2,911,768 for honing either an exterior cylindrical surface which is receivable within an opening at the bottom of the honing tool or for honing an interior cylindrical surface which is located concentric with the tool. There has been a need for a honing tool which is suitable for honing a first exterior cylindrical surface and then for honing a second interior cylindrical offset surface concentric with the first cylindrical surface.

SUMMARY OF THE INVENTION

The invention comprises a method and a honing apparatus. The honing apparatus has an expansion mechanism externally located with respect to the tool body. One or more radially movable honing stones are mounted circumferentially around an end region of a cylindrical tool body. Each stone is bonded or attached to a tool holder pivotally attached to the tool body. An axially movable feed sleeve surrounds the tool body. The feed sleeve carries one or more inwardly oriented expansion wedges. One wedge is associated with each honing stone. The wedges are arranged circumferentially around an inner surface of the sleeve. Each of the expansion wedges is operative to engage an associated tool holder pivotably attached to the tool body. As the feed sleeve is moved axially, each expansion wedge also moves axially and pivots each tool holder thereby moving the honing stone supported by that tool holder essentially radially with respect to the work surface being honed. In addition to its axial motion, the feed sleeve rotates simultaneously with the rotation of the tool body.

In one embodiment of the invention, suitable for honing an exterior cylindrical surface, a set of honing stones is arranged circumferentially around an interior surface of a hollow elongated tool body. Positioned between each pair of honing stones is a fixed nylon workpiece guide. In this embodiment, as the feed sleeve is moved axially, the honing stones are moved essentially radially inwardly toward the cylindrical workpiece, located within the hollow elongated tool body.

In a second embodiment of the invention, suitable for honing an interior cylindrical surface, concentric with an offset external surface previously honed, a hollow elongated tool body carries thereon a plurality of honing stones circumferentially located around an external surface of the tool body. Each stone is bonded to a tool holder pivotally attached to the tool body. Between each pair of movable honing stones is a fixed nylon workpiece guide. A radially inwardly movable plurality of nylon workpiece guides is mounted circumferentially around an interior surface of the hollow elongated tool body. Associated with the plurality of inwardly movable guides is an annular expansion ring adapted to slidable axially along the tool body. A set of expansion springs located around the tool body between the tool body and annular expansion ring biases the ring, axially, toward the workpiece. The axial spring bias of the expansion ring toward the workpiece drives each of the movable nylon guides radially inwardly toward the previously honed offset, exterior cylindrical surface thus continuously centering this embodiment of the invention with respect to that previously honed cylindrical surface. An axially movable feed sleeve surrounds the tool body. A set of expansion wedges carried on the feed sleeve interacts with the pivotally mounted tool holders to drive the honing stones essentially radially outward toward the interior cylindrical surface. The plurality of radially movable honing stones circumferentially arranged around the external surface of the tool body of this embodiment then hones the second, interior cylindrical surface, making that surface concentric with the first external cylindrical surface.

Each honing stone is bonded to its tool holder so that there is a cutting surface of the stone located at the end of the tool body. As a result, the exterior surface to be honed can be honed adjacent to a terminating shoulder. The interior surface to be honed can be honed adjacent to an interior perpendicular surface which terminates the cylindrical surface being honed.

The method of honing an interior cylindrical surface concentric with cylindrical offset surface comprises the steps of: honing the cylindrical external surface; locating the previously honed external surface within a hollow elongated tool body; continuously centering the tool body with respect to the previously honed external surface; moving a honing stone substantially radially with respect to the tool body, into contact with the interior cylindrical offset surface to be honed; honing the interior cylindrical surface.

DETAILED DESCRIPTION OF THE PREFERRED EMBODIMENTS

Not by way of limitation but by way of disclosing the best mode of practicing my invention and by way of enabling one of ordinary skill in the art to practice my invention, there are shown in FIGS. 1–8 two embodiments of my invention.

Figure 1:
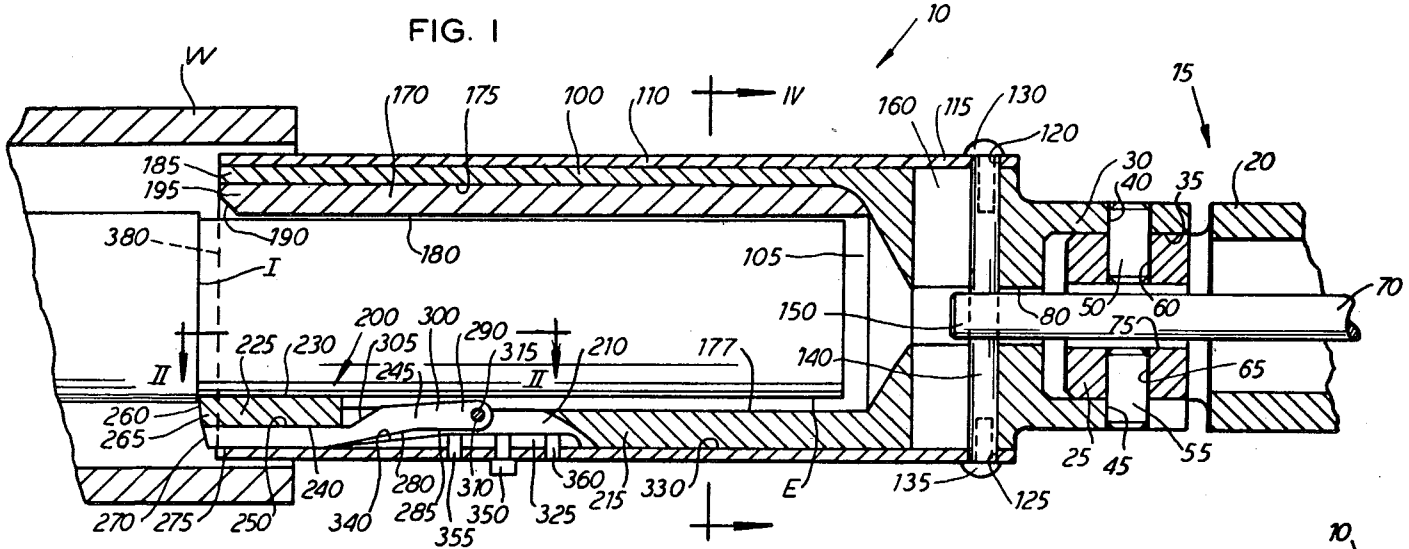
FIG. 1 is a sectional view of one embodiment of the inventive tool.

In FIG. 1 an exemplary honing tool 10 is shown in position to hone an external cylindrical surface E of a workpiece W. The surface E of the workpiece W terminates at a shoulder I. A honing tool 10 is shown in FIG. 1 connected to a source of motion 15. The driving source 15 is conventional in the art and forms no part of the present invention. The source 15 includes an external cylindrical member 20 which is rotated by a driving motor not shown. The rotary member 20 has a universal block 25 which is received within a hollow corresponding connection end 30 of the honing tool 10. The connection end 30 of the tool 10 has an inner cylindrical region 35 and a pair of borings 40, 45. A pair of pins 50, 55 extend through the borings 40, 45 of the connection 30 of the honing tool 10 and into a second set of borings 60, 65 in the block 25 of the rotary member 20. Thus, the connection 30 is rigidly pinned to the block 25 of the rotary member 20.

The driving mechanism 15 also includes a rigid elongated cylindrical shaft 70 which is located within the rotary member 20 and which passes through a boring 75 in the block 25 of the rotary member 20. The rigid elongated shaft 70 also passes through a second boring 80 which is located in the connection end 30 of the honing tool 10. The elongated shaft 70 moves axially within the rotary member 20 for the purpose of driving an expansion means within the honing tool 10.

The honing tool 10 includes an elongated, rigid, hollow body member 100 with an interior cylindrical volume 105. Surrounding the body member 100 and slidable with respect to the body member 100 is a hollow, elongated, rigid expansion sleeve 110. The expansion sleeve 110 at a connection end 115 has a pair of holes 120, 125 through which extend a pair of locking screws 130, 135. The locking screws pass into a rigid feed pin 140 which is transversely mounted at an end 150 of the shaft 70.

A hollow region 160 which is adjacent the feed pin 140, within the body member 100, provides a volume through which the feed pin 140 moves as the elongated shaft 70 moves axially with respect to the rotary member 20 of the driving means 15. As the feed pin 140 moves within the region 160 away from the connection end 30 of the body member 100 of the honing tool 10, the feed sleeve 110 is moved axially with respect to the body member 100. The feed sleeve 110 in addition to moving axially with respect to the body member 100 rotates with the body member 100 in response to the rotary motion of the rotating member 20 of the drive mechanism 15.

A rigid elongated nylon guide 170 is mounted within a slot 175 on an interior surface 177 of the body member 100. The nylon guide 170 has a workpiece engaging surface 180 which runs the entire length of the guide. At an open end 185 of the body member 100 of the honing tool 10 the nylon guide 170 has a biased surface 190 which is adjacent an end region 195 of the nylon guide 170. The purpose of the biased surface 190 is to minimize the difficulty of inserting the external cylindrical surface E of the workpiece W into the interior volume 105 of the hollow elongated body member 100.

A means for honing 200 is mounted in a concave region 210 adjacent a central portion 215 of the hollow elongated body member 100. The honing means 200 includes a honing element 225 of a selected size and shape with a honing surface 230 located adjacent the external cylindrical surface E of the workpiece W. A surface 240, parallel to the honing surface 230 of the honing element 225 is bonded to a tool holder 245 at an elongated planar surface 250. A second honing surface 260 located adjacent an end 265 of the honing element 225 joins the surfaces 230, 240. A biased surface 270 at the end of the tool holder 245 joins the surface 250 to an expansion surface 275. The expansion surface 275 joins a second bias surface 280. The second biased surface 280 in turn is connected to a surface 285 which in part defines an end region 290 of the tool holder 245. The end region 290 is further defined by a semicircular surface 295, an elongated surface 300 and a third bias surface 305. The surface 305 in turn joins the surface 250. In the end region 290, a boring 310 slidably receives a pin 315 which is retained by the elongated rigid hollow body member 100. The tool holder 245 rotates about the pin 315.

An expansion wedge 325 is affixed to an interior cylindrical surface 330 of the expansion sleeve 110. The wedge 325 includes a second expansion surface 340. The expansion wedge 325 is rigidly attached to the expansion sleeve 110 by a screw 350 and a pair of pin members 355, 360.

As the expansion sleeve 110 is driven axially toward the terminating shoulder I of the workpiece W, the expansion surface 340 of the expansion wedge 325 engages the expansion surface 275 of the tool holding member 245. Since the surface 340 is at an angle with respect to the surface 275 and is moving axially with respect thereto, the expansion surface 275 of the tool holding member 245 is driven inwardly toward the exterior cylindrical surface E of the workpiece W. As a result, the honing surface 230 of the honing stone 225 is also driven into the exterior cylindrical surface E thus producing the necessary honing. While each of the means for honing 200, 400, 405, 410 pivots with respect to an associated retaining pin, such as the pin 315, the honing effect on the exterior reference surface E is analogous to the honing effect obtainable if the means for honing 200, 400, 405, 410 moved only radially toward the surface E without pivoting.

The surfaces 230 of the honing stone 225 and the surface 180 of the nylon workpiece guide 170 cooperate so that the tool 10 is able to supply the necessary honing pressure to the exterior cylindrical surface E of the workpiece W. As the tool 10 moves axially toward the shoulder I which terminates the end of the exterior cylindrical surface E, the region 265 of the honing stone 225 is operative to hone the exterior cylindrical surface E all the way down to the terminating shoulder I. If desired, the external terminating surface 260 of the honing stone 225 could also be used to hone the terminating shoulder I. It should be noted that the end surface 260 and the end region 265 of the honing stone 225 extend outwardly from an end surface 380 of the tool body 100.

Figure 2:
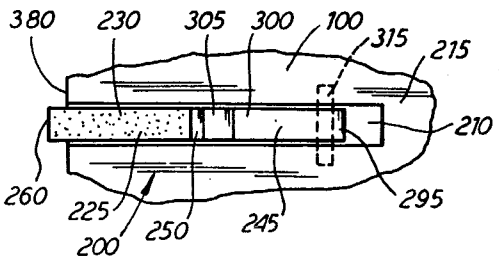
FIG. 2 is a fragmentary view taken along line II—II of FIG. 1 showing the details of the pivotal mounting of a tool holder.

FIG. 2, a view taken along line II—II of FIG. 1 with the tool body 100 shown as a fragment further shows the detail of the means for honing 200. The honing stone 225 is shown with the honing surface 230, and the honing surface 260. The surface 260 extends outwardly beyond the end surface 380 of the tool body 100. The tool holder 245 is shown in FIG. 2 pinned into the concave region 210 by the pin 315.

Figure 3:
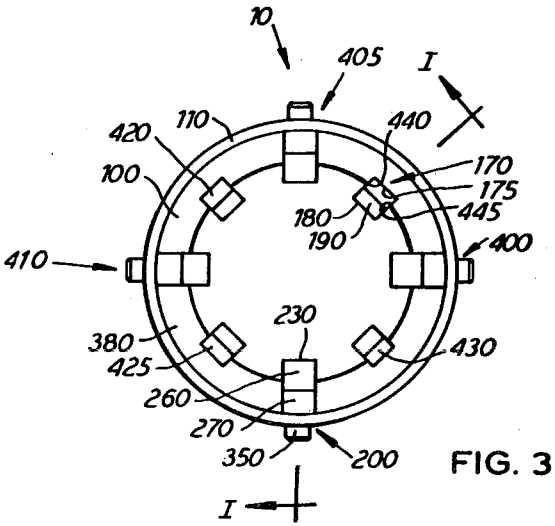
FIG. 3 is an end view of the tool of FIG. 1.

FIG. 3 an end view of the honing tool 10 shows a plurality of honing means 400, 405, 410 each of which is identical to the previously described honing means 200. The honing means 200, 400, 405, 410 are shown in FIG. 3 distributed uniformally around the tool body 100. FIG. 3 also shows a plurality of nylon workpiece guides 420, 425, 430 which are identical to the nylon workpiece guide 170. The workpiece guides 170, 420, 425, 430 are all retained within slots located on the surface 177 of the hollow tool body 100. A description of the slot associated with the guide 170 will also describe the retaining slots for the guides 420, 425, 430. A pair of parallel sides 440, 445 joins the rear supporting surface 175 in the hollow tool body 100.

Figure 4:
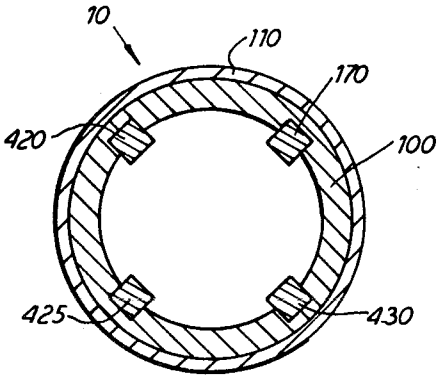
FIG. 4 is a section taken along line IV—IV of FIG. 1.

FIG. 4, a section taken along line IV—IV of FIG. 1 shows the plurality of workpiece guides 170, 420, 425 and 430 located circumferentially around the tool body 100.

Figure 5:
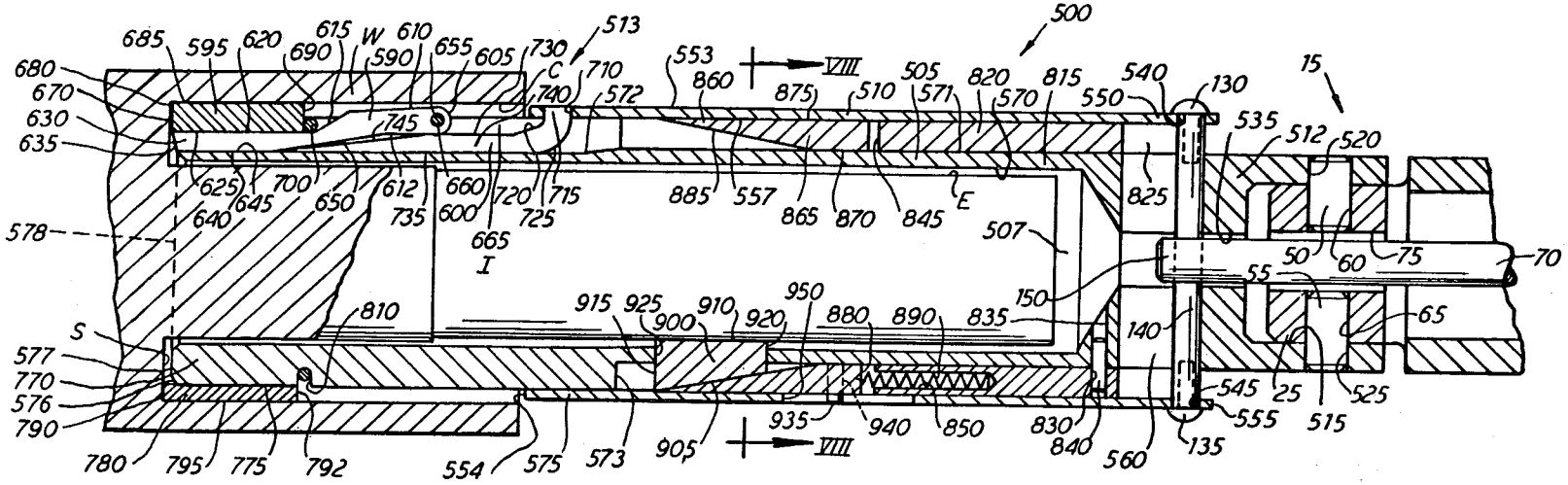
FIG. 5 is a sectional view of a second embodiment of the inventive tool.

In FIGS. 5 through 8 a second embodiment of my invention is shown. A tool 500 as shown in FIGS. 5 through 8 is suitable for honing an interior cylindrical surface C which is offset with respect to the exterior cylindrical reference surface E of the workpiece W and which is to be concentric with the exterior cylindrical surface E. The interior cylindrical surface C terminates at a surface S. The drive means 15 is shown in FIG. 5 with corresponding elements having the same identification numbers as in FIG. 1.

The tool 500 has an elongated cylindrical tool body member 505 with an interior workpiece receiving central volume 507. The body 505 is surrounded by an elongated cylindrical expansion sleeve 510. A means for honing 513 is located at an end of the tool body 505.

The hollow tool body 505 has a connection block 512 which is analogous to the connection member 30 attached to the tool body 100 of the tool 10. The block 512 is hollow having an interior cylindrical surface 515. The universal block 25 of the drive apparatus 15 is received within the hollow connection block 512, adjacent the cylindrical surface 515. A pair of holes 520, 525 in the connection block 512 receive a pair of pin members 50, 55 to lock the universal block 25 of the rotary member 20 to the hollow elongated tool body 505. A boring 535 in the connection block 512 in conjunction with the boring 75 in the universal block 25 provides a path through which the axially movable expansion shaft 70 passes and imparts axial expansion motion to the transverse pin 140. The pin 140 passes through a pair of holes 540, 545 at a connection end 550 of the axially movable expansion sleeve 510. A pair of screws 130, 135 lock the transverse pin 140 to the axially movable expansion sleeve 510. A region 560 within the hollow tool body 505 is provided to enable the feed pin 140 to move axially with respect to the tool body 505 in response to axial motion of the rigid shaft 70 of the drive mechanism 15.

The hollow tool body 505 has an interior cylindrical surface 570 which bounds the interior volume 507 which receives the previously honed external cylindrical surface E of the workpiece W. The tool body 505 has an external cylindrical surface 571 adjacent the volume 560. The surface 571 has a shift depression 572 formed thereon to receive the means for honing 513. The tool body 505 also has a shoulder 573 adjacent a surface 575 of greater diameter than the surface 571. The tool body 505 terminates at an exterior biased surface 570, a planar surface 577 essentially perpendicular to the body 505 and an internal biased surface 578 adjacent the surface 507.

The axially movable feed sleeve 510 has an interior cylindrical surface 551, an external concentric cylindrical surface 553 and is terminated at a perpendicular surface 554.

The means for honing 513 is oriented to hone the interior cylindrical surface C of the workpiece W concentric with the offset exterior cylindrical reference surface E. The means for honing 513 includes a tool holder 590, a honing stone 595 and an expansion wedge 600. The tool holder 590 has a curved end surface 605 which joins a pair of substantially planar elongated parallel surfaces 610, 612. The surface 610 joins a biased surface 615 which is adjacent to a surface 620 which is bonded to a surface 625 of the honing stone 595. An end region 630 of the tool holder 590 has a biased end surface 635 adjacent the stone supporting surface 620. The biased end surface 635 is adjacent an expansion surface 640 which is located adjacent an exterior surface 645 in the depression 572 in the tool body 505. A biased surface 650 connects the expansion surface 640 to the end surface 612 of the tool holder 590. The tool holder 590 also has a hole 655 adjacent the curved end surface 605 through which passes a pivoting pin 660. The pivoting pin 660 is retained within a concave region 665 of the tool body 505 and permits the tool holder 590 to pivot.

The honing stone 595 has a biased end surface 670 adjacent the surface 625 bonded to the tool holder 590. The biased end surface 670 is located adjacent the terminating surface S of the interior cylindrical surface C of the workpiece W. A corner 680 of the honing stone 595 which is adjacent the biased end surface 670 is operative to hone the cylindrical interior surface C immediately adjacent the terminating surface S of the workpiece W. The honing stone 595 also has a planar honing surface 685 which extends from the corner 680 adjacent the interior cylindrical surface C of the workpiece W to be honed. The honing surface 685 of the honing stone 595 terminates on a substantially perpendicular planar surface 690.

A circular compression garter spring 700 passes around the tool holder 590 adjacent the biased surface 615 and tends to pivot the tool holder 590 away from the interior cylindrical surface C of the workpiece W and toward the hollow elongated tool body 505. The expansion wedge 600 is received through a slot 710 which is located in the expansion sleeve 510. The expansion wedge 600 has an end portion 715 which is retained within the slot 710. The end portion 715 is joined to a first and a second curved surface 720, 725 which turn the end region 715 of the expansion wedge 600 at 90° with respect to a pair of elongated parallel surfaces 730, 735 which define a body portion 740 of the expansion wedge 600. The body portion 740 is terminated by a biased expander surface 745 which joins the two elongated parallel surfaces 730, 735 of the body portion 740.

As the feed sleeve 510 is moved axially toward the terminating surface S of the interior cylindrical surface C of the workpiece W the expander surface 745, which is at a selected angle with respect to the direction of axial motion of the feed sleeve 510 is forced beneath the expansion surface 640 of the tool holder 590. The coaction of the expansion surface 640 on the tool holder 590 and the expander surface 745 on the expansion wedge 600 pivots the honing stone 595 essentially radially outwardly toward the cylindrical surface C to be honed as the tool holder 590 pivots about the pivoting pin 660.

To counterbalance the forces being applied by the honing surface 685 of the honing stone 595 against the interior cylindrical surface C, the tool 500 at an end region 770 on the surface 575 adjacent the exterior biased surface 576 has affixed thereto an elongated rigid nylon guide 780. The guide 780 has a pair of substantially parallel end surfaces 790, 792 which are perpendicular to a workpiece engaging surface 795. The workpiece engaging surface 795 is a parallel elongated surface which is driven into contact with the interior cylindrical surface C of the workpiece W as the honing stone 595 is driven outwardly by the axial motion of the feed sleeve 510. The end region 770 also includes a slot 810 which cooperates to retain the garter compression spring 700.

Located between the tool body 505 and the axially movable expansion sleeve 510 adjacent the region 560 of the body member 505 is an interior cylindrical member 820. The member 820 is formed with an upper region 825 adjacent the region 560 of the tool body 505 to permit axial motion of the feed pin 140 in response to the axial movement of the feed shaft 70. The cylindrical member 815 also has a boring 830 which is in line with a boring 835 of the tool body 505. A locking pin 840 located in the borings 830, 835 rigidly locks the cylindrical member 820 to the tool body 505. The cylindrical member 820 terminates in a perpendicular annular surface 845. A slot 850 is located on the cylindrical member 820 adjacent the annular surface 845.

A guide feed sleeve 860 located between the tool body 505 and the expansion sleeve 510 has an annular cylindrical portion 865 which is located adjacent the terminating surface 845 of the fixed cylindrical member 820. The region 865 has an interior cylindrical surface 870 and a parallel spaced apart outer cylindrical surface 875. The guide feed sleeve 860 is slidable on the surfaces 870, 875 with respect to the exterior cylindrical surface 571 of the tool body 505 and the interior cylindrical surface 551 of the expansion sleeve 510. An annular biased surface 885 connects the two cylindrical surfaces 870, 875. The surface 885 serves as an expansion surface on the guide feed sleeve 860. An expansion spring 890 located in the slot 850 of the fixed cylindrical member 820 applies force against an upper terminating surface 880 of the guide feed sleeve 860 biasing the guide feed sleeve 860 axially along the tool body 505 toward the end region 770 of the body 505.

An inwardly movable nylon guide 900 has an outer expansion surface 905 which cooperates with the expansion surface 885 of the guide feed sleeve 860. The movable nylon guide 900 also has an inner workpiece engaging surface 910 which is adjacent the exterior cylindrical surface E which was previously honed by the tool 10. The surface 910 is bounded by a pair of perpendicular spaced apart surfaces 915, 920. The surfaces 915, 920 are slidably received within a slot 925 in the tool body 505. As the expansion spring 890 drives the guide feed sleeve 860 axially toward the end region 770, the inwardly movable nylon guide 900 is forced against the external cylindrical reference surface E which was previously honed. The co-action of the external cylindrical surface E and the adjacent surface 910 of the nylon guide 900, one of a plurality spaced circumferentially about the exterior cylindrical surface E, centers the tool 500 with respect to the exterior cylindrical surface E. As a result, the interior cylindrical surface C is honed concentric with the exterior cylindrical reference surface E by the honing stone 595.

Because of the inward, essentially radial movement of the nylon guide 900 under the influence of a biasing spring 890, a guide sleeve return 935 which is threadedly received in a boring 940 of the guide feed sleeve 860 is designed to extend through a slot 950 in the feed sleeve 510 so that the bias effects of the spring 890 may be manually offset thereby permitting the movable nylon guide 900 to be retracted with respect to the interior cylindrical surface 570 of the tool body 505 for the purpose of inserting the external cylindrical surface E of the workpiece W into the tool body 505.

Figure 6:
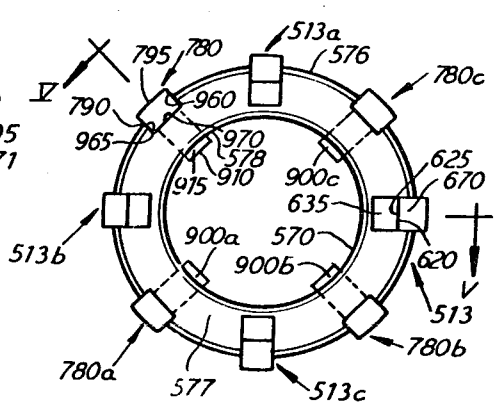
FIG. 6 is an end view of the tool of FIG. 5.

FIG. 6 an end view of the tool 500 shown in section in FIG. 5 shows the means for honing 513 along with additional means for honing **513*a*, 513*b* and 513*c* distributed circumferentially around the tool body 505. The means for honing 513*a*, 513*b* and 513*c* have a structure corresponding to that of the means for honing 513 which was previously described. Additionally, interspersed circumferentially around the tool body 505 is a plurality of fixed nylon guides 780*a*, 780*b*, 780*c* each of which corresponds in structure to the fixed nylon guide 780 which was previously described. The nylon guide 780 is mounted on the tool body 505 in a slot having parallel sides 960, 965 and a base 970. The fixed honing guides 780*a*, 780*b* and 780*c* are mounted in similar slots in the tool body 505. Also, shown in FIG. 6 are a plurality of radially inwardly movable guides 900*a*, 900*b* and 900*c* corresponding in structure to the movable guide 900** previously described.

Figure 7:
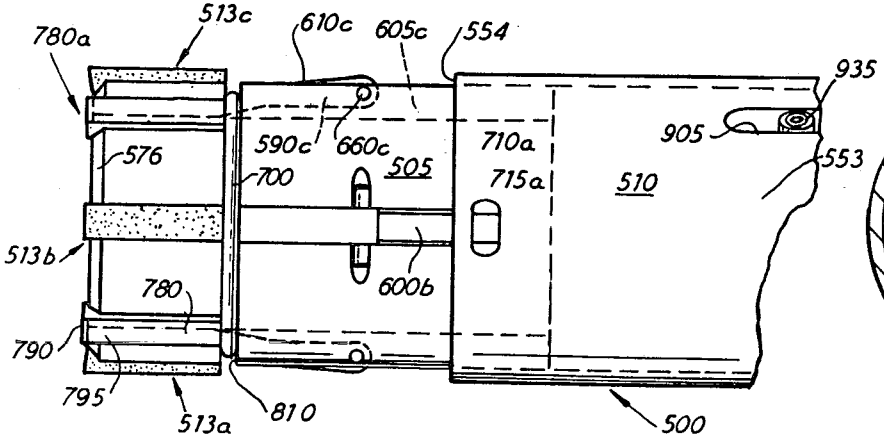
FIG. 7 is a fragmentary side elevation of the tool of FIG. 5.

FIG. 7, a fragmentary side view of the tool 500 further shows the circumferential arrangement of the honing means **513*a*, 513*b* and 513*c*. Interspersed with the honing means are the fixed nylon guides 780, 780*a*. The expansion sleeve 510 which externally surrounds the tool body 505 is shown supporting an exemplary expansion wedge 600*b* associated with the means for honing 513*b*. Additionally, the slot 950 is shown in the sleeve 510 providing the access to the guide sleeve return 935. The circumferential garter spring 700 is shown retracting each of the means for honing 513, 513*a*, 513*b* and 513*c***.

Figure 8:
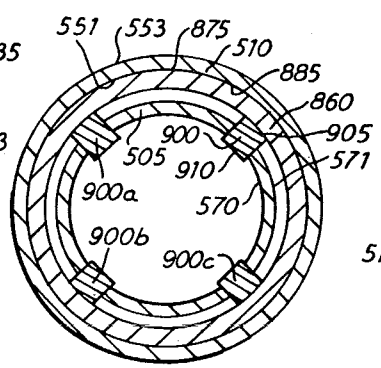
FIG. 8 is a section taken along line VIII—VIII of FIG. 5.

FIG. 8, a section taken along line VIII—VIII of FIG. 5 shows the relationship between the exterior feed sleeve 510, the movable guide feed sleeve 860 and the tool body 505. FIG. 8 also shows the radially inwardly movable nylon guides **900, 900*a*, 900*b* and 900*c***.

While those skilled in the art might suggest various modifications and changes, it will be understood that I wish to include within the claims of the patent warranted hereon all such modifications and changes as reasonably come within my contribution of the art.

We claim as our invention:

1. In a honing tool suitable to hone a cylindrical surface substantially to a terminating surface, including an elongated cylindrical hollow tool body with a plurality of tool holders circumferentially mounted on a selected end region thereof, with each tool holder supporting a honing stone, an improvement wherein: said tool body is formed with a cylindrical wall having a selected essentially constant thickness, and includes a plurality of elongated slots formed in said cylindrical wall in said selected end region of said tool body, said slots are circumferentially spaced around said end region, each said slot has two parallel, spaced apart axially oriented side surfaces formed in said cylindrical wall; each said tool holder is positioned essentially completely within a corresponding slot in said cylindrical wall between said spaced apart axially oriented surfaces; means for pivotally attaching each tool holder to said tool body, each said means for attaching is positioned to extend between said spaced apart axially oriented surfaces within a corresponding slot and is attached to at least one selected region within said cylindrical wall, each said means is adapted to pivotally attach an end of a said respective tool holder positioned within said slot to said cylindrical wall; means for expansion, said means for expansion substantially surrounds the tool body, is axially movable, and is operative to engage a region located within a corresponding slot on each said tool holder and pivot each member of said plurality of tool holders inwardly toward the surface being honed, wherein the hollow cylindrical tool body is adapted to receive therein a workpiece with a cylindrical surface to be honed and wherein said means for expansion includes a hollow cylindrical outer portion with a plurality of surfaces offset with respect to an axis of said cylindrical outer portion, and wherein said means for expansion and each said means for pivotally attaching cooperate to pivot each tool holder inwardly toward the surface of the workpiece to be honed in response to axial movement of said means for expansion in a selected direction along said cylindrical tool body, and wherein each said pivotally mounted tool holder supports the associated honing stone with a selected end region of the stone exposed to hone the reference cylindrical surface adjacent a terminating surface, and wherein said means for expansion engages each of said tool holders at a location between said means for pivotally attaching each of said tool holders to said tool holder and said selected end, and a plurality of elongated plastic members mounted in slots in said cylindrical wall in said selected end region of said tool body so as to engage said cylindrical surface.

* * * * *